United States Patent [19]

Knowlton

[11] Patent Number: 5,027,464

[45] Date of Patent: Jul. 2, 1991

[54] CONTAINER DUMPING SYSTEM

[75] Inventor: Christopher M. Knowlton, Pinehurst, N.C.

[73] Assignee: AAR Corporation, Aberdeen, N.C.

[21] Appl. No.: 461,190

[22] Filed: Jan. 5, 1990

[51] Int. Cl.[5] ..... E01H 1/04

[52] U.S. Cl. ..... 15/83; 298/11; 414/697

[58] Field of Search ..... 15/83-86, 15/340.3, 340.4; 414/697, 708; 298/11

[56] References Cited

U.S. PATENT DOCUMENTS 2,614,279 10/1952 Mott ..... 15/83
3,186,015 6/1965 Beyerstedt ..... 15/84
3,634,900 1/1972 Prescott et al. ..... 15/84
4,178,647 12/1979 Wolynec et al. ..... 15/84

FOREIGN PATENT DOCUMENTS 758490 10/1956 United Kingdom ..... 414/697

*Primary Examiner*—Edward L. Roberts
*Attorney, Agent, or Firm*—Harness, Dickey & Pierce

[57] ABSTRACT

A sweeper vehicle having an improved hopper lift mechanism which provides a relatively high lift for dumping the hopper at ground level as well as into relatively high containers, while at the same time positioning the driver at a much lower and hence, safer position than normally found in currently available sweeper vehicles. The vehicle also eliminates the use of overlapping lifting arms to increase safety and provides superior driver visibility at all times.

12 Claims, 8 Drawing Sheets

FIG. 7.
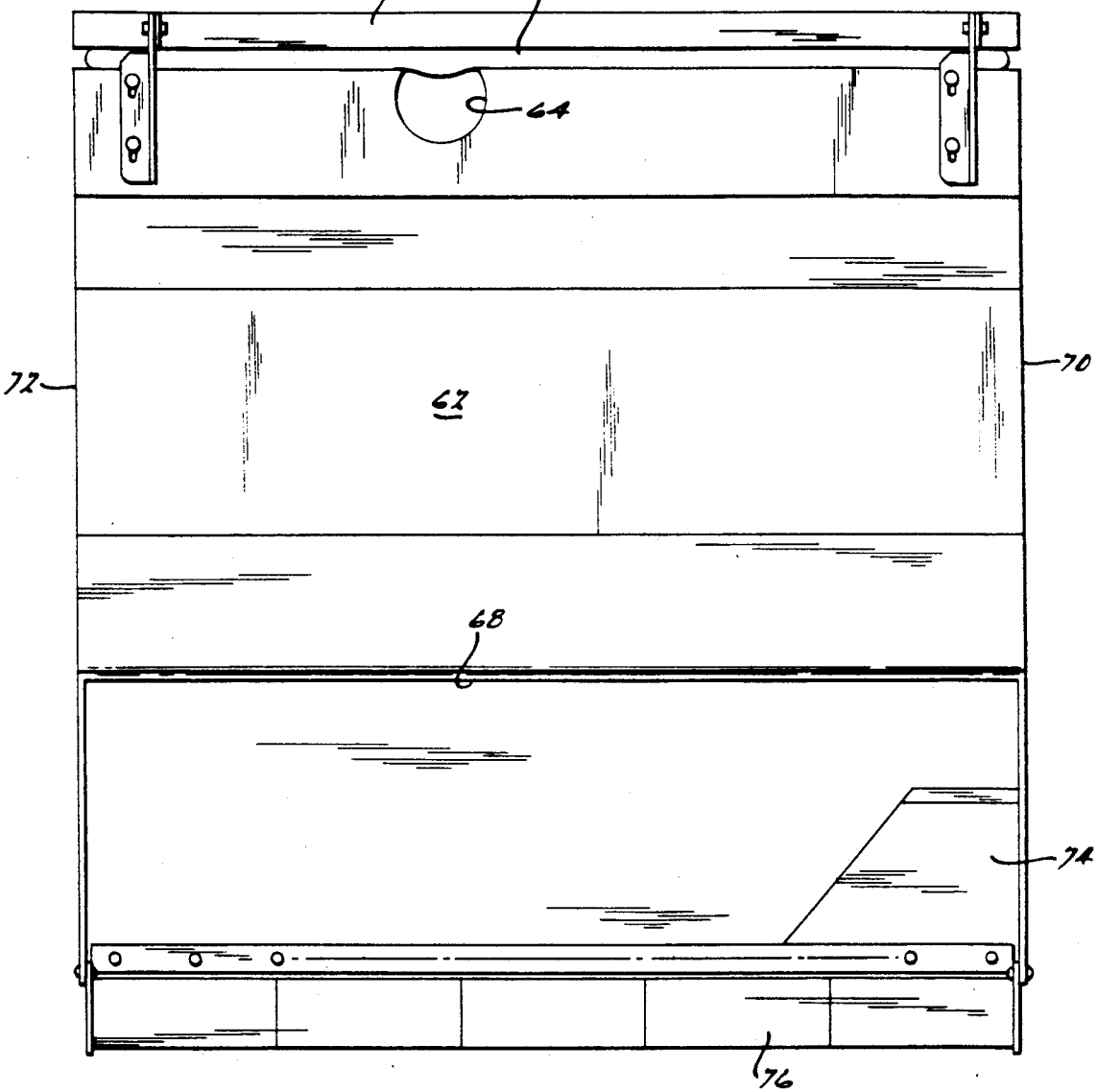
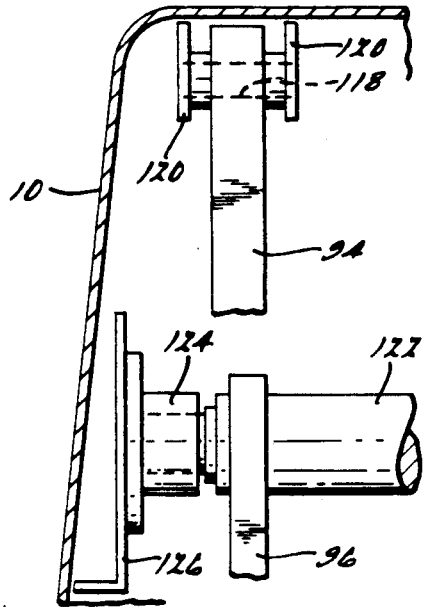
FIG. 11.

CONTAINER DUMPING SYSTEM

BACKGROUND AND SUMMARY OF THE INVENTION

The present invention relates to refuse collection and dumping systems and more particularly to a sweeper vehicle having an improved hopper lift mechanism which provides a relatively high lift for dumping the hopper at ground level as well as into relatively high containers while at the same time positioning the driver at a much lower and hence safer position than normally found in currently available sweeper vehicles. Related objects of the invention include the provision of such a vehicle which eliminates the use of lifting arms which overlap one another, thus reducing a possible hazard, which provides superior driver visibility at all times including a good view of the forward corner rotary brush, which is relatively simple to fabricate and operate, which provides for simple hopper lip cleaning, and which presents a stylish appearance.

These and other objects and advantages will become more apparent when viewed in light of the accompanying drawings and following detailed description.

BRIEF DESCRIPTION OF THE DRAWING FIGURES

FIG. 7 is a rear elevational view of the hopper of FIG. 6;

FIG. 8 is a view of the linkage mechanism for raising, dumping and lowering the hopper of FIG. 6, shown in its at rest, normal loading position;

FIG. 11 is a sectional view taken substantially along line 11—11 in FIG. 5.

DETAILED DESCRIPTION OF THE PREFERRED EMBODIMENT

Figure 1:
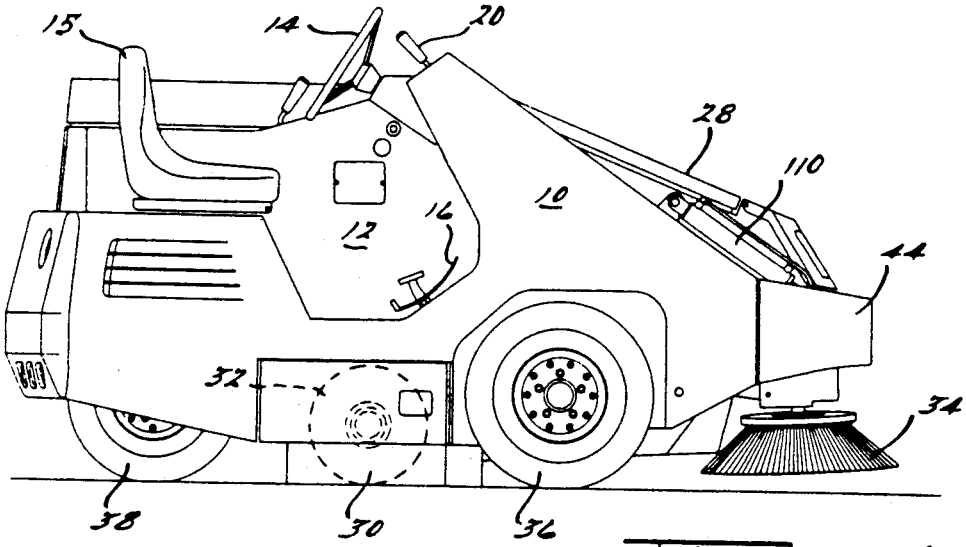
FIG. 1 is a side elevational view with the right side of a sweeper vehicle embodying the principles of the present invention.
Figure 2:
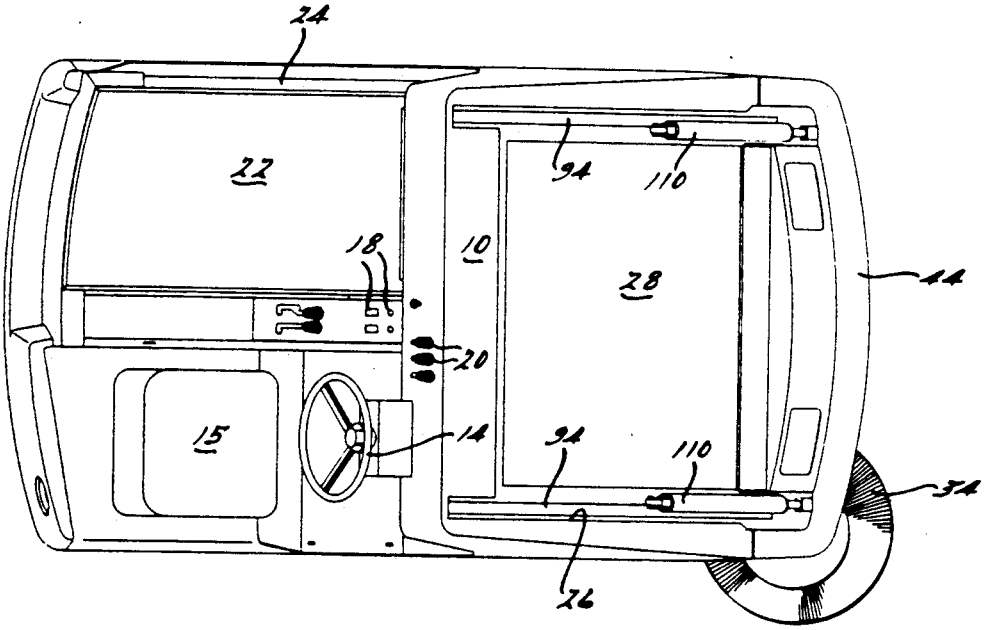
FIG. 2 is a top plan view of the vehicle of FIG. 1.
Figure 3:
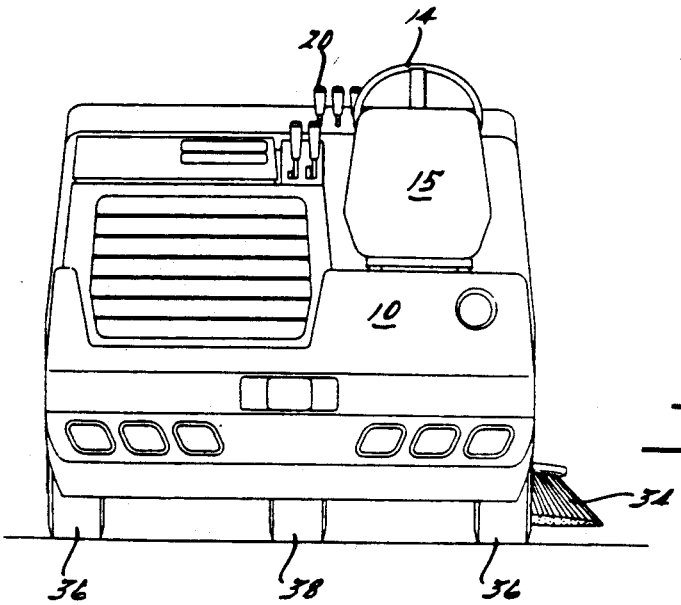
FIG. 3 is a rear elevational view of the vehicle of FIG. 1.

Referring first to FIGS. 1—5, the overall sweeper vehicle comprises a body 10 supported on a conventional frame and defining an open operator's compartment 12 having the usual steering wheel 14, a seat 15, foot pedals 16, instruments 18 and sweeper controls 20; a rear engine compartment 22 having an upper hinged hood 24 and containing a conventional engine, hydraulic pump and the usual accessories; a forward hopper receiving cavity 26 in which a hopper 28 is mounted for loading, lifting and dumping; a conventional sweeper assembly 30 including a rotary broom 32 for sweeping refuse into hopper 28; and a rotary side brush 34. The vehicle also includes a pair of conventional front wheels 36 and a single driven steerable rear wheel 38 of the usual type. Wheel 38 may be powered by a hydraulic motor (not shown). Except for the novel features hereinafter described, the vehicle is constructed and functions in a conventional manner.

Figure 4:
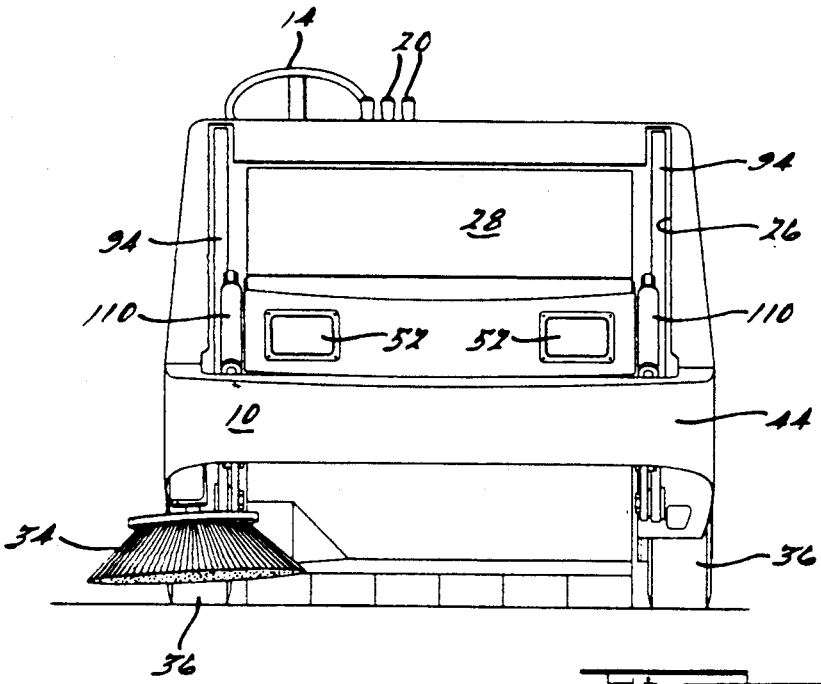
FIG. 4 is a front elevational view of the vehicle of FIG. 1.
Figure 5:
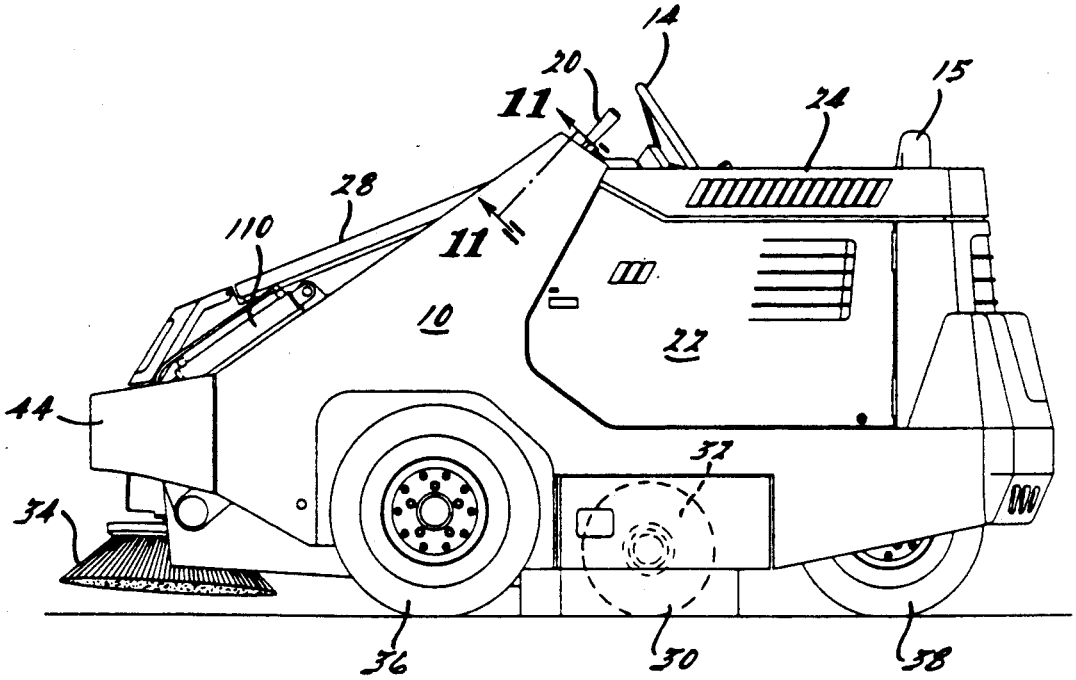
FIG. 5 is a side elevational view of the left side of the vehicle of FIG. 1.
Figure 6:
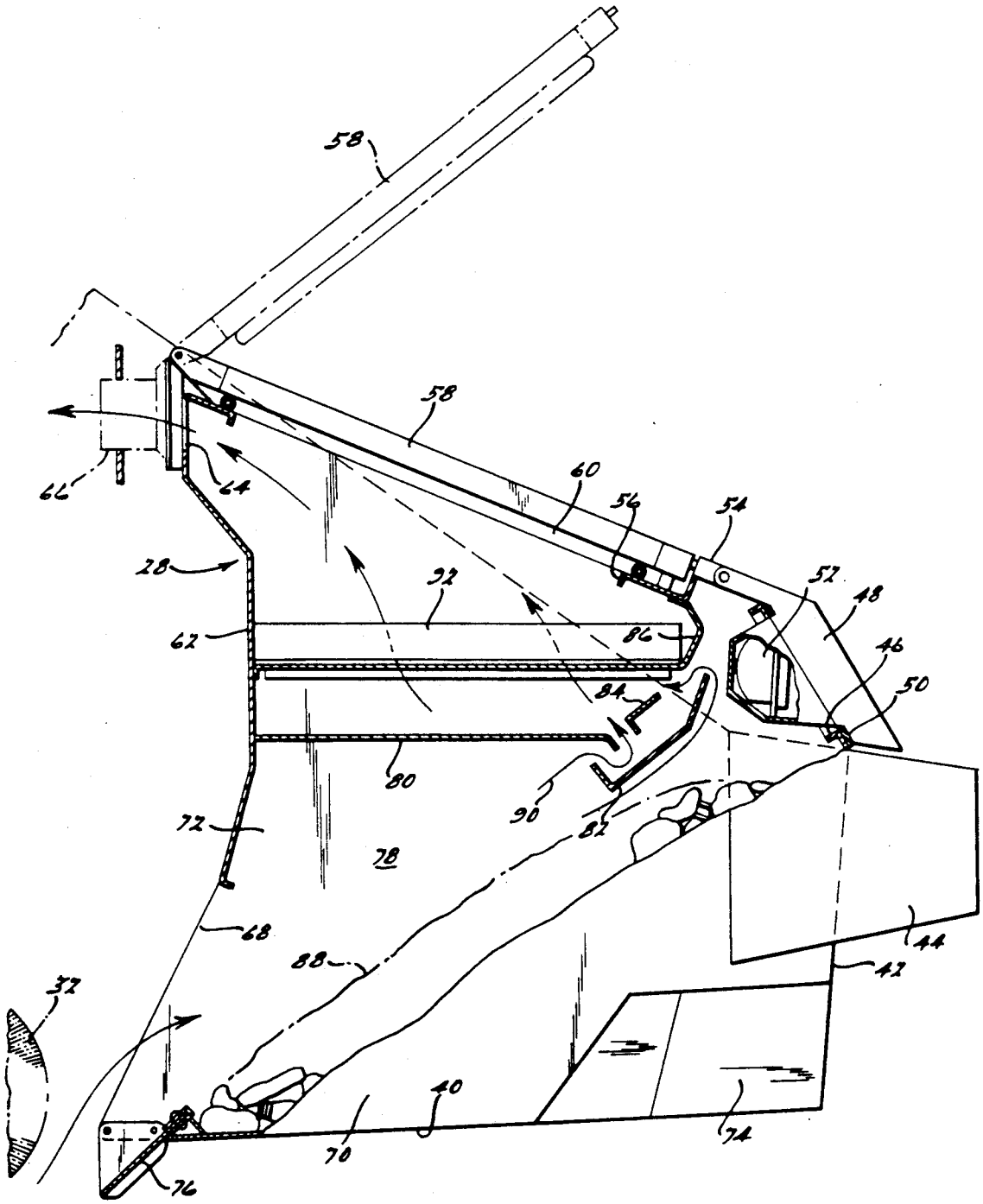
FIG. 6 is a side elevational view of the refuse hopper forming a portion of the vehicle of FIG. 1.
Figure 5:
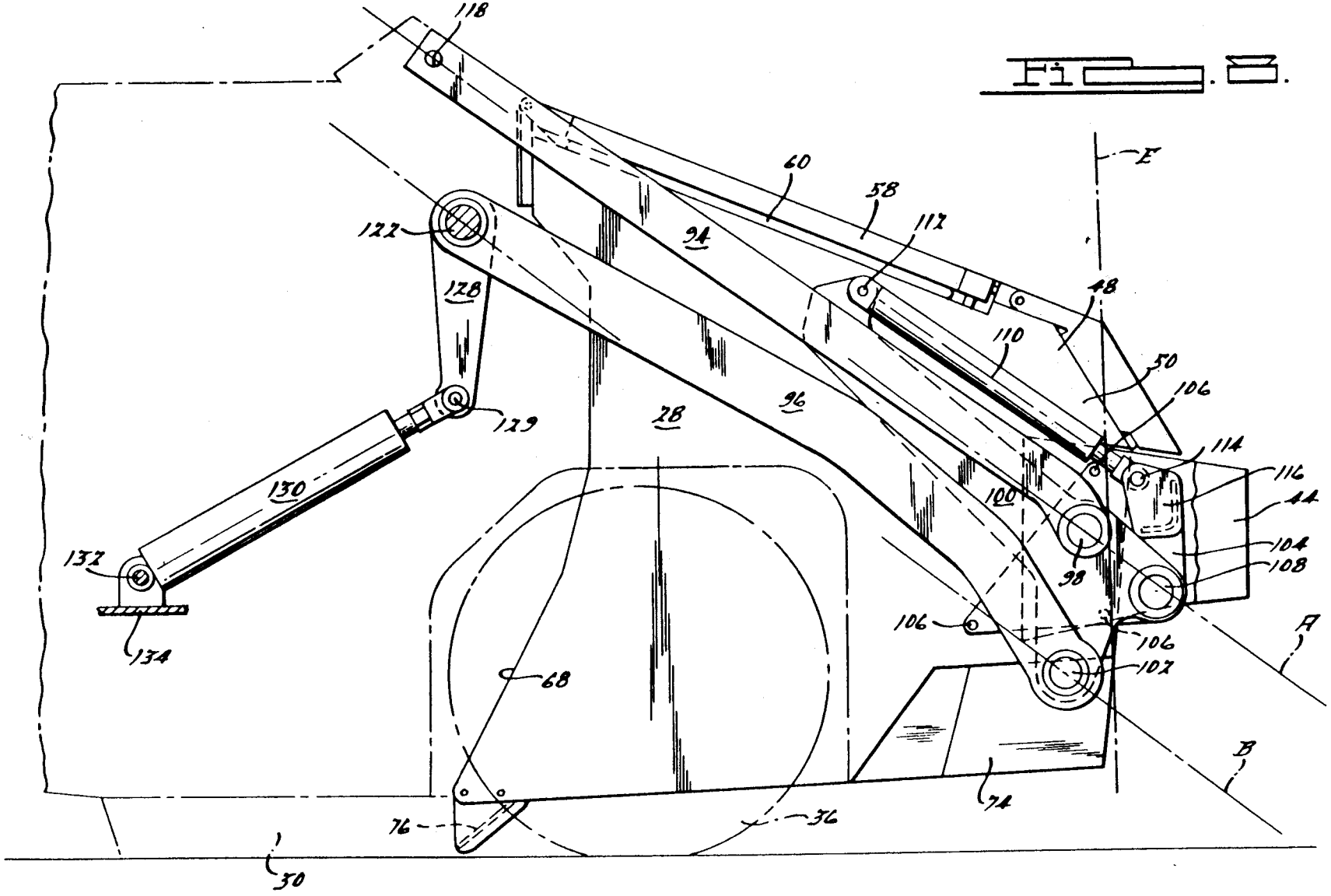

The details of construction of hopper 28 are best understood with reference to FIGS. 4, 6 and 7. Refuse hopper 28 is of welded sheet metal construction of the overall configuration shown, and comprises: a fully sealed bottom wall 40, a front wall 42 on which is disposed a front bumper 44 affixed thereto configured to blend with the rest of the vehicle in its loading position and an opening 46 normally closed by hinged lid 48 having a peripheral seal 50 and in which are mounted a pair of head lamps 52; a top wall 54 having an opening 56 normally closed by a latchable hinged lid 58 having a peripheral seal 60; a rear wall 62 having an upper circular opening 64 adapted to be connected to the inlet 66 of the usual powered vacuum blower (not shown) to perform a dust control vacuuming operation by drawing air through the hopper, and a refuse inlet opening 68 adjacent broom 32 adapted and positioned to receive refuse swept up by broom 32; and fully enclosed side walls 70 and 72. A cavity 74 is provided at the lower front right corner of the hopper to provide clearance for rotary brush 34, and an elastomeric slotted deflector flap 76 is mounted across the lower edge of opening 68 to help deflect all refuse into the hopper.

As best shown in FIG. 6, the interior of hopper 28 comprises a lower refuse storage compartment 78 defined by transversely extending air-deflecting baffles 80, 82, 84 and 86, the normal maximum level of refuse being generally indicated at 88. These baffles cause the air to flow in the path of arrow 90 which has a sufficiently large change in direction to inertially separate the heavier air-borne solids from the remainder of the air flow, which is thereafter directed upwardly and rearwardly through a filter assembly 92 which removes the remaining air-borne fines prior to discharge of the air through opening 64 to the vacuum blower. Conventional filter cleaning devices may be employed to keep filters 92 clean.

Actuation of the hopper from its at rest or loading position (FIG. 6) is accomplished by a unique improved linkage system, as best seen in FIGS. 8–11. The linkage system is affixed to each side of the hopper, and because each side is the mirror image of the other, only one will be described. Basically, each side of the hopper comprises a generally straight upper control arm 94 pivotally connected at its forward end at 98 to a control link 100, a lower actuating arm 96 pivotally connected at its forward end at 102 to control link 100 and being slightly offset intermediate its ends to clear the well for wheel 36, a bracket 104 bolted to hopper 28 at 106 and being pivotally connected at 108 to link 100, and a hydraulic cylinder 110 pivotally connected at one end at 112 to link 100 and at its opposite end at 114 to bracket 104 via clevis 116.

Figure 12:
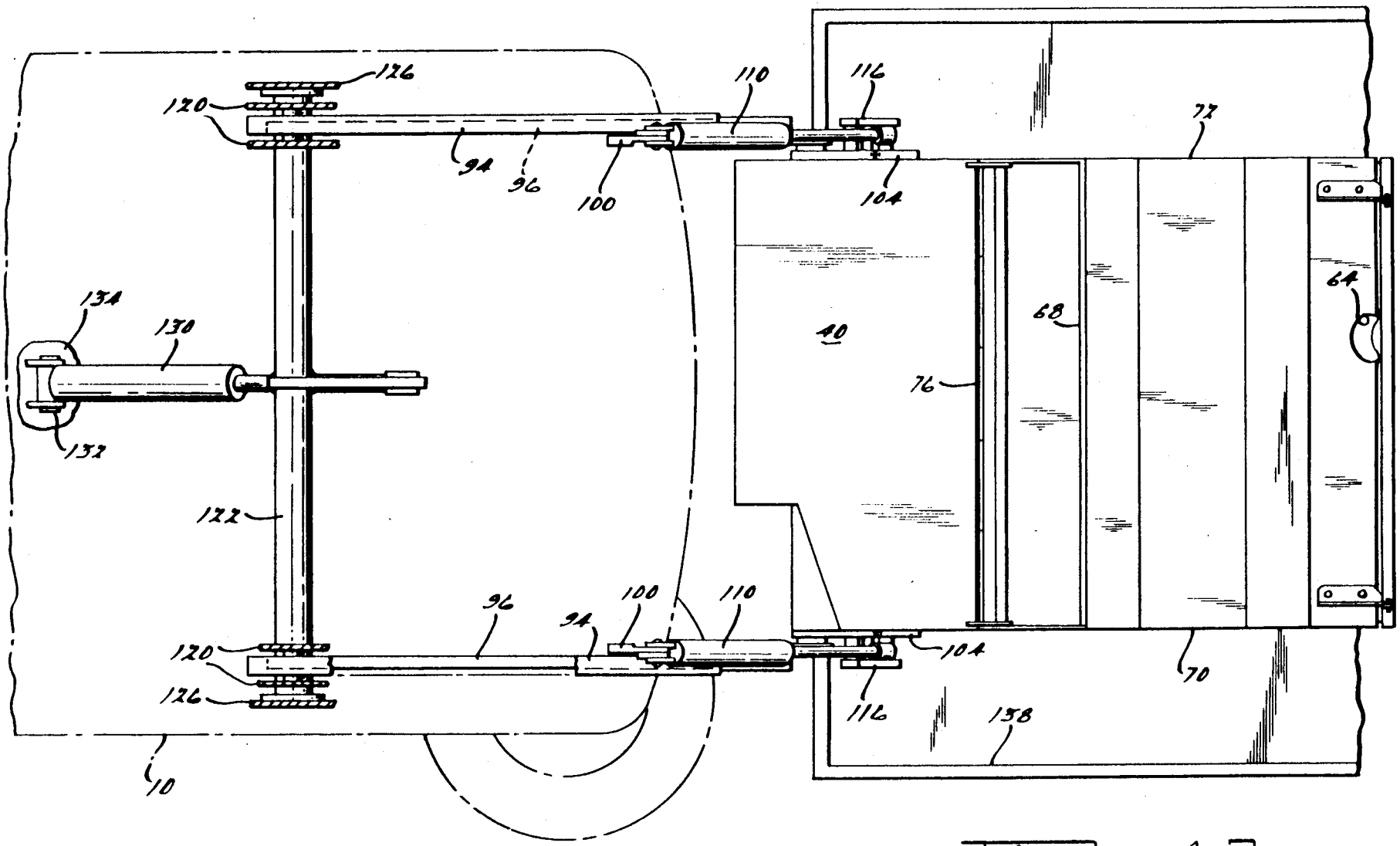
FIG. 12 is a top plan view of the apparatus of the present invention shown in its dumping position of FIG. 10.

The rearward end of each control arm 94 is pivotally affixed at 118 to a pair of support members 120 affixed to the vehicle frame (not shown), and the rearward end of each actuating arm 96 is fixedly secured to a transversely disposed actuating shaft 122 rotationally supported at each end by a trunion 124 affixed to a bracket 126 affixed to the vehicle frame (not shown), as best seen in FIGS. 8, 11 and 12. Affixed rigidly to shaft 122 adjacent its center is a crank arm 128 having its free end pivotally connected at 129 to a fluid motor in the form of a hydraulic cylinder 130, the opposite end of which is pivotally connected at 132 to a portion of the vehicle frame shown at 134 in FIGS. 8 and 11. All hydraulic devices are connected by appropriate lines via controls 20 to the usual engine-driven or motor-driven hydraulic pump (not shown).

Arms 94 and 96 are arranged in such a way as to significantly improve the operators visibility. One way this is accomplished is by lowering the upper pivot points and extending the lower pivot points more forwardly than usual. As can be seen in FIG. 8, with respect to the embodiment shown a line A through both pivots on each arm 94 and a line B through both pivots on each arm 96 are both disposed at an angle of approximately 37° with respect to a horizontal plane. In any case, lines A and B are preferably inclined at an angle less than 40% with regard to a horizontal plane. This results in the upper pivot points 118 being disposed substantially below the operator's normal lowermost forward line of vision, indicated at C in FIG. 9, thus maximizing forward vision.

Another feature of the present layout is that the front corner rotary sweeper is positioned sufficiently forwardly (its vertical axis of rotation E is in approximate alignment with the lower arm pivots 98 and 102) that it can easily reach into a corner, and is disposed sufficiently laterally that it can be easily seen by the operator.

Figure 9:
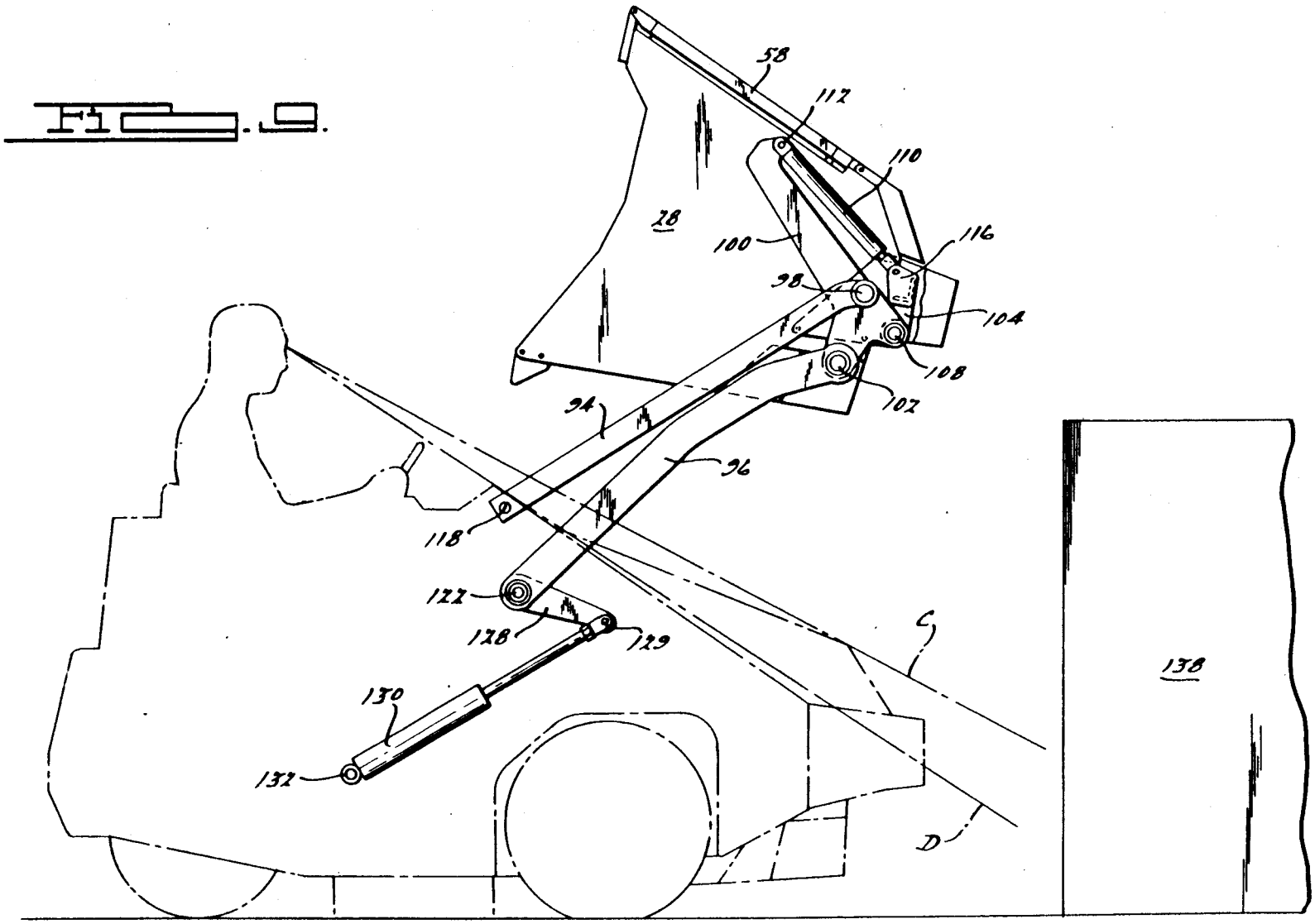
FIG. 9 is a view similar to FIG. 8 showing the hopper in its fully raised position.
Figure 10:
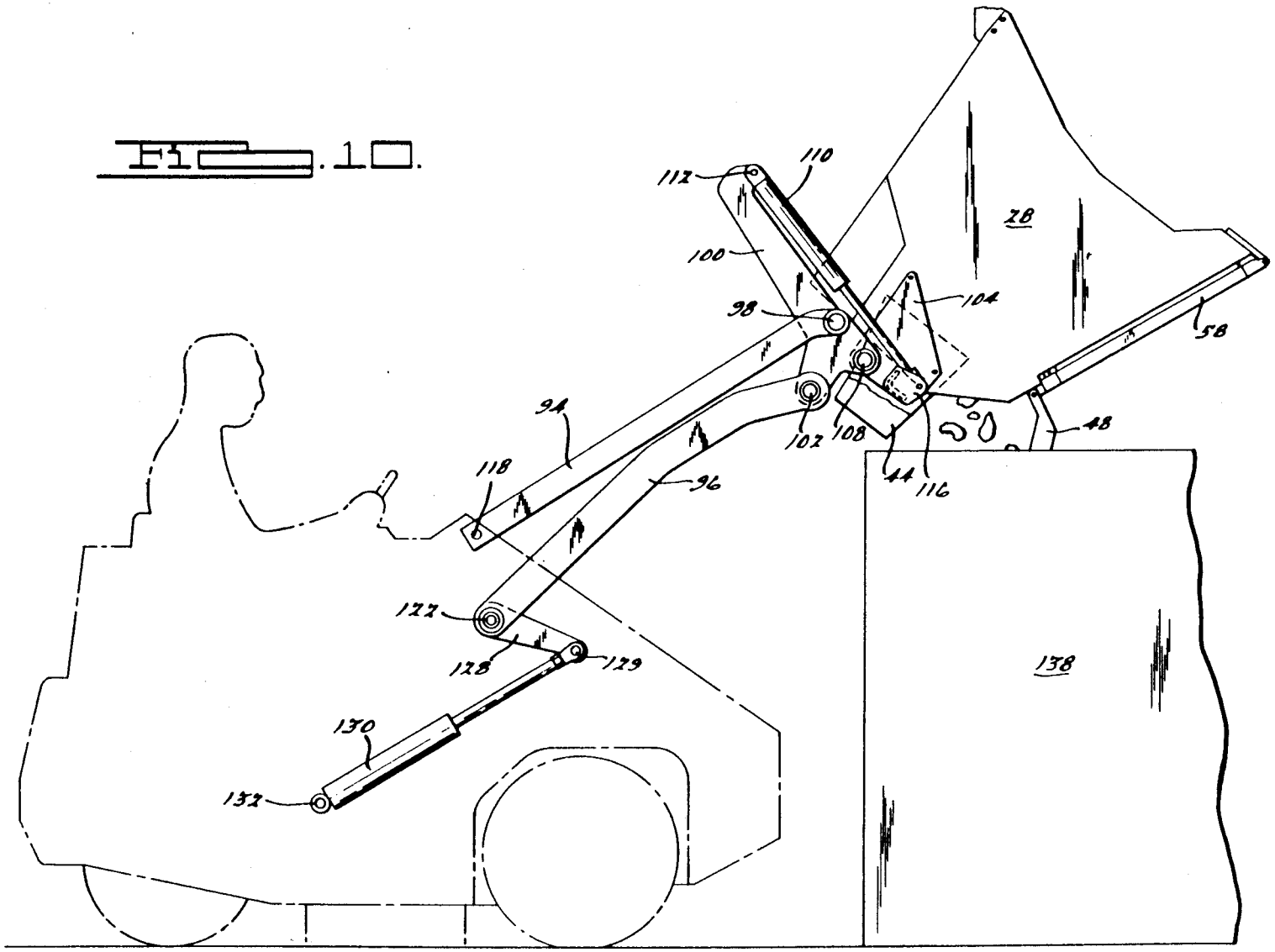
FIG. 10 is a view similar to FIG. 8 showing the hopper in its dumping position.

The refuse dumping cycle of the apparatus is best seen with reference to FIGS. 8–10. The hopper is shown in its normal loading position in FIG. 8, where opening 68 is in alignment with broom 32, lid 48 is in a convenient position to be manually opened for insertion of refuse too large to be swept up by the vehicle, and arms 94 and 96 are disposed within cavity 26. As can be seen, the geometry of the parts is such that not only is the operator seated at an unusually low and hence safer position, but he is also provided with excellent visibility. For example, note the operator's lowermost forward sight-line C in FIG. 9 which illustrates how close to the front of the vehicle objects on the floor can be seen, even when the hopper is in its lowermost position. When the hopper is raised, this sight-line is even lower, as indicated at D.

When it is desired to dump the hopper the appropriate hydraulic control is actuated to energize cylinder 130 which will extend to cause each actuating arm 96 to rotate in a counterclockwise direction as shown to raise the hopper to whatever height is desired (up to approximately sixty inches), as shown in FIG. 9. The vehicle is then advanced toward the refuse container, as at 138, and the appropriate control is actuated to extend each cylinder 110 to cause hopper 28 to rotate in a clockwise direction as shown to the position illustrated in FIG. 10, whereupon gravity will cause lid 48 to fall open and the refuse in chamber 78 to fall into container 138. Note again how good the operator's visibility is in this position. The above sequence is simply reversed to return the hopper to its normal loading position. The mechanism is also capable of easily clearing the hopper lip at the bottom of opening 68. To do this, the operator merely actuates the mechanism to lift the hopper until it is clear of the vehicle and then rotate the hopper only part way to its dumping position, thus causing any loose refuse on the lip to fall all the way into the hopper. The hopper is then lowered and sweeping resumed.

Thus there is disclosed in the above description and in the drawings an embodiment of the invention which fully and effectively accomplishes the objects thereof. However, it will be apparent that variations in the details of the apparatus may be indulged in without departing from the spirit of the invention herein described, or the scope of the appended claims.

I claim:

1. A sweeper vehicle comprising: a frame; a vehicle body supported on said frame and having an operator's compartment including an operator's seat; a power source connected to said frame for powering said vehicle; a refuse hopper disposed at the front of said vehicle; a transversely disposed horizontal shaft connected to said frame and journaled for rotation with respect thereto; a pair of generally parallel first arms having one end rigidly affixed, respectively, to said shaft adjacent the opposite ends thereof and normally extending forwardly and downwardly adjacent the outside sides of said hopper; a pair of links pivotally connected, respectively, to the opposite sides of said hopper adjacent the forward end thereof, each of said links being pivotally connected to the forward end of one of said first arms; a pair of generally parallel second arms having one end pivotally connected to said frame and normally extending forwardly and downwardly adjacent the outside sides of said hopper, said pair of second arms being generally parallel to and in approximate vertical alignment with and above said pair of first arms, the forward end of each of said connected arms being pivotally connected to the adjacent link, each of said second arms being arranged so that a line through the pivots at each end thereof is normally disposed at an angle of 40° or less with respect to a horizontal plane; a first motor for rotating said shaft to cause said arms to raise and lower said hopper; and a second motor connected between one of said links and the adjacent side of said hopper for causing said hopper to pivot with respect to said pair of links between a generally upright position and an inverted dumping position.

2. A sweeper vehicle as claimed in claim 1 wherein said angle is between 30° and 40°.

3. A sweeper vehicle as claimed in claim 2 wherein said angle is approximately 37°.

4. A sweeper vehicle as claimed in claim 1 wherein said second motor consists of a single fluid motor disposed intermediate the ends of said shaft.

5. A sweeper vehicle as claimed in claim 4 wherein said power source is disposed in one rear quadrant of said vehicle and said operator's compartment is disposed in the other rear quadrant of said vehicle, and wherein said first motor is disposed between said operator's compartment and said power source.

6. A sweeper vehicle as claimed in claim 1 further comprising a third motor connected between the other of said links and the adjacent side of said hopper to cooperate with said second motor for causing said hopper to rotate with respect to both said pairs of arms between a generally upright position and an inverted dumping position.

7. A sweeper vehicle as claimed in claim 1 wherein the upper pivot point of each of said second arms is disposed substantially below the operator's normal lowermost forward line of sight.

8. A sweeper vehicle comprising: a frame; a vehicle body supported on said frame and having an operator's compartment including an operator's seat; a power source connected to said frame for powering said vehicle; a refuse hopper disposed at the front of said vehicle; a transversely disposed horizontal shaft connected to said frame and journaled for rotation with respect thereto; a pair of generally parallel first arms having one end rigidly affixed, respectively, to said shaft adjacent the opposite ends thereof and normally extending forwardly and downwardly adjacent the outside sides of said hopper; a pair of links pivotally connected, respectively, to the opposite sides of said hopper adjacent the forward end thereof, each of said links being pivotally connected to the forward end of one of said first arms; a pair of generally parallel second arms having one end pivotally connected to said frame disposed substantially below the operator's normal lowermost forward line of straight and normally extending forwardly and downwardly adjacent the outside sides of said hopper, said pair of second arms being generally parallel to and in approximate vertical alignment with and above said pair of first arms, the forward end of each of said second arms being pivotally connected to the adjacent link; a first motor for rotating said shaft to cause said arms to raise and lower said hopper; and a second motor connected between one of said links and the adjacent side of said hopper for causing said hopper to pivot with respect to said pair of links between a generally upright position and an inverted dumping position.

9. A sweeper vehicle comprising: a frame; a vehicle body supported on said frame and having an operator's compartment including an operator's seat; a power source connected to said frame for preventing said vehicle; a refuse hopper disposed at the front of said vehicle; a transversely disposed horizontal shaft connected to said frame and journaled for rotation with respect thereto; a pair of generally parallel first arms having one end rigidly affixed, respectively, to said shaft adjacent the opposite ends thereof and normally extending forwardly and downwardly adjacent the outside sides of said hopper; a pair of links pivotally connected, respectively to the opposite sides of said hopper adjacent the forward end thereof, each of said links being pivotally connected to the forward end of one of said first arms; a pair of generally parallel second arms having one end pivotally connected to said frame and normally extending forwardly and downwardly adjacent the outside sides of said hopper, said pair of second arms being generally parallel to and in approximate vertical alignment with and above said pair of first arms, the forward end of each of said second arms being pivotally connected to the adjacent link; a first motor for rotating said shaft to cause said arms to raise and lower said hopper; and a second motor connected between one of said links and the adjacent side of said hopper for causing said hopper to pivot with respect to said pair of links between a generally upright position and an inverted dumping position, said arms being configured so that the two arms one each side of the hopper never overlap each other in normal operation.

10. A sweeper vehicle as claimed in claim 9 wherein said vehicle has a pair of front wheels disposed at opposite sides thereof respectively, each of said second arms is generally straight, and each of said first arms is slightly offset intermediate its ends in order to clear the adjacent front wheel.

11. A sweeper vehicle comprising: a frame; a vehicle body supported on said frame and having an operator's compartment including an operator's seat; a power source connected to said frame for powering said vehicle; a refuse hopper disposed at the front of said vehicle; a powered sweeper brush disposed at and extending from the right front corner of the vehicle, said brush being mounted for rotation about a generally vertical axis; a transversely disposed horizontal shaft connected to said frame and journaled for rotation with respect thereto; a pair of generally parallel first arms having one end rigidly affixed, respectively, to said shaft adjacent the opposite ends thereof and normally extending forwardly and downwardly adjacent the outside sides of said hopper; a pair of links pivotally connected, respectively, to the opposite sides of said hopper adjacent the forward end thereof, each of said links being pivotally connected to the forward end of one of said first arms; a pair of generally parallel second arms having one end pivotally connected to said frame and normally extending forwardly and downwardly adjacent the outside sides of said hopper, said pair of second arms being generally parallel to and in approximate vertical alignment with and above said pair of first arms, the forward end of each of said second arms being pivotally connected to the adjacent link, the lower pivots on said first and second arms being disposed on the right hand side of the vehicle and being positioned in approximate vertical alignment with the center of said sweeper brush; a first motor for rotating said shaft to cause said arms to raise and lower said hopper; and a second motor connected between one of said links and the adjacent side of said hopper for causing said hopper to pivot with respect to said pair of links between a generally upright position and an inverted dumping position.

12. A sweeper vehicle as claimed in claim 11 wherein said lower pivots are disposed just slightly behind said vertical axis and wherein the right hand one of said links is pivotally connected to said hopper just slightly in front of said axis.

* * * * *

UNITED STATES PATENT AND TRADEMARK OFFICE

CERTIFICATE OF CORRECTION

PATENT NO. : 5,027,464

DATED : July 2, 1991

INVENTOR(S) : Christopher M. Knowlton

It is certified that error appears in the above-identified patent and that said Letters Patent is hereby corrected as shown below:

Column 4, line 30, Claim 1, "connected" should be -- second --.

Column 5, line 15, Claim 8, "straight" should be -- sight --.

Column 5, line 30, Claim 9, "preventing" should be -- powering --.

Column 6, line 4, Claim 9, "one" should be -- on --.

Signed and Sealed this

Twelfth Day of January, 1993

*Attest:*

DOUGLAS B. COMER

*Attesting Officer*

*Acting Commissioner of Patents and Trademarks*